US009896248B2

(12) United States Patent
Chen et al.

(10) Patent No.: US 9,896,248 B2
(45) Date of Patent: Feb. 20, 2018

(54) BAR BOTTLE

(71) Applicant: Franke Technology and Trademark Ltd., Hergiswil (CH)

(72) Inventors: Chi-En Chen, Vancouver (CA); Blago Lakic, Vancouver (CA)

(73) Assignee: FRANKE TECHNOLOGY AND TRADEMARK LTD. (CH)

( * ) Notice: Subject to any disclaimer, the term of this patent is extended or adjusted under 35 U.S.C. 154(b) by 0 days.

(21) Appl. No.: 15/046,751

(22) Filed: Feb. 18, 2016

(65) Prior Publication Data

US 2017/0240323 A1 Aug. 24, 2017

(51) Int. Cl.
*B65D 5/72* (2006.01)
*B65D 47/06* (2006.01)
*B65D 25/48* (2006.01)

(52) U.S. Cl.
CPC ..... *B65D 47/06* (2013.01); *B65D 25/48* (2013.01)

(58) Field of Classification Search
CPC .... B65D 47/06; B65D 2205/02; B65D 47/32; B65D 51/16; B65D 25/48
USPC ..... 222/566–570, 572, 574
See application file for complete search history.

(56) References Cited

U.S. PATENT DOCUMENTS 217,127 A * 7/1879 Luckhardt ..... B65D 47/06 137/130
1,143,525 A 6/1915 Ferris
1,970,798 A 8/1934 Daly
2,286,906 A 6/1942 Gaines
2,298,957 A 10/1942 Mazzarelli
2,477,984 A 8/1949 Jackson
D165,577 S 1/1952 Fuld
D165,646 S 1/1952 Fuld
D167,916 S 10/1952 Voight
2,664,228 A 12/1953 Radeloff
3,063,589 A 11/1962 Musel
3,104,786 A 9/1963 Sanchis
3,139,224 A 6/1964 Bloom
3,235,133 A 2/1966 Zimmerman
(Continued)

FOREIGN PATENT DOCUMENTS

DE 102005036784 A1 2/2006
EP 1010628 B1 3/2005
(Continued)

OTHER PUBLICATIONS

Juice Pourers; https:/www.barproducts.com/bar-owners/pourers/juice-pourers; published prior to Jan. 11, 2016.
(Continued)

*Primary Examiner* — Lien Ngo
(74) *Attorney, Agent, or Firm* — Bergman & Song LLP; Michael Bergman

(57) ABSTRACT

A dispensing bottle has a spout formed integrally with a neck that extends to a body of the bottle. The spout comprises first and second passages oriented at an angle to the neck. A partition inside the neck forms an extension of the second passage. The partition extends at least to a base of the neck such that air entering the second passage is carried through the neck and released into the body of the bottle. The bottle may have first and second parts detachably affixed together.

18 Claims, 5 Drawing Sheets

(56) References Cited

U.S. PATENT DOCUMENTS

| | | | | |
|---|---|---|---|---|
| 3,338,482 | A * | 8/1967 | Jordan | B65D 25/48 222/479 |
| 3,422,998 | A | 1/1969 | Murray | |
| 3,430,826 | A | 3/1969 | Microulis | |
| 3,750,915 | A | 8/1973 | Kearney | |
| 4,452,381 | A * | 6/1984 | Freeman | B65D 25/48 220/DIG. 13 |
| D274,791 | S | 7/1984 | Freeman | |
| D290,686 | S | 7/1987 | Board | |
| 4,871,096 | A | 10/1989 | Horian | |
| D356,934 | S | 4/1995 | Lenox | |
| D369,550 | S | 5/1996 | Crosby | |
| 5,746,358 | A | 5/1998 | Crosby | |
| D421,908 | S | 3/2000 | Abrams | |
| D438,117 | S | 2/2001 | Shefler | |
| 6,196,425 | B1 | 3/2001 | Fielding et al. | |
| 6,230,944 | B1 | 5/2001 | Castellano et al. | |
| D452,436 | S | 12/2001 | Darr | |
| D587,571 | S | 3/2009 | Gonzales, Jr. | |
| 8,011,540 | B1 | 9/2011 | Peckels | |
| D649,046 | S | 11/2011 | Baker | |
| 8,079,484 | B2 | 12/2011 | Wachsberg | |
| D668,953 | S | 10/2012 | Maxwell | |
| D671,010 | S | 11/2012 | Shefler | |
| 8,403,185 | B2 * | 3/2013 | Vachon | B67D 7/005 141/309 |
| D679,600 | S | 4/2013 | Gonzalez Rodriguez | |
| D776,354 | S | 1/2017 | Schlatter | |
| 2003/0046971 | A1 | 3/2003 | Enoki | |
| 2008/0099514 | A1 | 5/2008 | Carter | |
| 2008/0272147 | A1 | 11/2008 | Buker | |
| 2010/0012617 | A1 | 1/2010 | Ulibarri | |
| 2011/0036873 | A1 | 2/2011 | Peckels | |
| 2012/0091171 | A1 | 4/2012 | Lovelace, III | |
| 2013/0319253 | A1 | 12/2013 | Smith | |
| 2013/0334161 | A1 | 12/2013 | Meager | |
| 2014/0252014 | A1 | 9/2014 | Bernstein et al. | |
| 2015/0174537 | A1 | 6/2015 | Foldesi, Jr. et al. | |
| 2015/0274384 | A1 * | 10/2015 | Goldstein | B65D 47/32 222/1 |
| 2016/0039583 | A1 | 2/2016 | Brown et al. | |
| 2016/0176589 | A1 | 6/2016 | Averill | |
| 2016/0229604 | A1 | 8/2016 | Carsello | |
| 2016/0297576 | A1 | 10/2016 | Hill | |

FOREIGN PATENT DOCUMENTS

| | | |
|---|---|---|
| GB | 688967 | 3/1953 |
| WO | WO 2011/097322 | 8/2011 |

OTHER PUBLICATIONS

KELLM High Precision No Drip Glass Olive Oil Bottle, posted at amazon.com, available Jun. 12, 2016, © 1996-2017 amazon.com, [online], [site visited Jan. 31, 2017]. Available from Internet, <URL: https://www.amazon.com/dp/B01GYAMADO?psc=1>.

Retro Glass Oil & Vinegar Bottles Cruet Set with Pourers, posted at amazon.com, available Sep. 26, 2012, © 1996-2017 amazon.com, [online], [site visited Jan. 31, 2017]. Available from Internet, <URL: https://www.amazon.com/Retro-Glass-Vinegar-Bottles-Pourers/dp/B009HOT5HI/ref=pd_sbs_79_30?_encoding=UTF8&psc=1&refRID=XGWF62J1Z24TOPTBW1QZ>.

Posi-Pour Use & Care by AlcoholControls.com, posted at YouTube.com, posted on Jul. 5, 2012, site visited Jan. 13, 2017, <https://www.youtube.com/watch?v=t9R1WUGHOLQ&feature=youtu.be>.

Everything You Never Wanted to Know About Pourers, posted at Thetruthaboutbartending.com, posted on Sep. 4, 2012, site visited Jan. 13, 2017, <http://thetruthaboutbartending.com/2012/09/04/everything-you-never-wanted-to-know-about-pourers/>.

Measured Liquor Bottle Pourers—1 1/2 oz, posted at Kegworks.com, posted on Oct. 22, 2015, site visited Jan. 13, 2017, <https://www.kegworks.com/measured-liquor-bottle-pourers-1-1-2-oz>.

12 Red Free Flow Liquor Pourer Pour Spouts, posted at Amazon.com, posted on Nov. 8, 2012, site visited Jan. 13, 2017, <https://www.amazon.com/Free-Flow-Liquor-Pourer-Spouts/dp/B00A3ZC7VM>.

* cited by examiner

BAR BOTTLE

FIELD

This invention relates to bottles suitable for dispensing beverages. Bottles according to the invention may be used by a bartender to dispense beverages such as mixers, juices, and the like.

SUMMARY

This invention has various aspects as discussed below. One aspect provides bar bottles that can be used for dispensing beverages. Specific aspects of the invention provide:

Bar bottles;

Components for bar bottles comprising integrated pour spouts.

One aspect provides a dispensing bottle comprising a neck and a body joined to a base of the neck. The body is larger in cross-section than the neck. A spout at an end of the neck remote from the body comprises at least a first passage and a second passage parallel to the first passage and smaller in cross-section than the first passage. The first and second passages are oriented at an angle to a longitudinal centerline of the neck. A partition is integrally formed with the neck and the spout. The partition is connected to the spout between the first and second passages and extends continuously along the neck from the spout to an opening at the base of the neck. The partition forms a continuation of the second passage.

The partition may be tapered in thickness such that parts of the partition closer to the spout are thicker than parts of the partition closer to the body and/or the extension of the second passage formed by the partition may be tapered such that a cross-section area of the portion of the extension of the second passage closer to the body is larger than a cross section area of the extension of the second passage closer to the spout.

A wall of the body of the bottle adjacent to the opening formed by the partition at the base of the neck may be oriented generally parallel to the first and second passages of the spout.

In some embodiments, in a cross-section of the neck and partition the pa Con is arcuate and joined along opposing edges to a wall of the neck.

An outer surface of the neck may be textured at least in a portion near the end of the neck remote from the body. The texture may be provided by features such as: circumferential grooves, roughness, points, bumps, indentations or the like. For example, the outer surface of the neck may be textured by a pattern of grooves extending circumferentially around the neck.

An enlarged-diameter portion may he provided at the end of the neck remote from. the body.

Some embodiments include an elastomeric sleeve at least partially covering the textured portion of the neck. The elastomeric sleeve may comprise a colored silicone material.

Some embodiments provide a bottle according to any described embodiment in combination with a set comprising a plurality of colored elastic sleeves. The plurality of elastic sleeves comprises elastic sleeves of a plurality of colors, each of the sleeves being dimensioned to resiliently slip over the neck of the bottle and to securely engage around the neck. Where the neck has an enlarged-diameter portion at or near its end the sleeves may be dimensioned to slip over the enlarged diameter portion and to engage the neck below the enlarged diameter portion. The elastic sleeves may comprise a colored silicone material, for example.

In some embodiments the body of the bottle comprises first and second detachable parts. The first part may be formed integrally with the neck and spout. The first and second parts may be detachably coupled together at a threaded coupling in a cylindrical portion of the body. In some embodiments all or part of the second portion of the body is transparent or translucent.

Some embodiments comprise a cover having a diameter larger than the body. The cover may be detachably affixed to a bottom end of the body. The cover may, for example, snap, grippingly receive and/or screw onto the bottom end of the body.

In any of the above embodiments the outer surfaces of the body and neck may be circularly symmetrical about a common axis coincident with the longitudinal centerline of the neck.

In an example embodiment the first part of the body, the neck and the spout are formed of injection-molded plastic.

In some embodiments the angle between the first and second passages and the longitudinal centerline of the neck is in the range of 20 to 60 degrees, about 45 degrees plus or minus 6 degrees in some embodiments.

Further aspects and example embodiments are illustrated in the accompanying drawings and/or described in the following description.

BRIEF DESCRIPTION OF THE DRAWINGS

The accompanying drawings illustrate non-limiting example embodiments of the invention.

DETAILED DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive sense.

Figure 1:
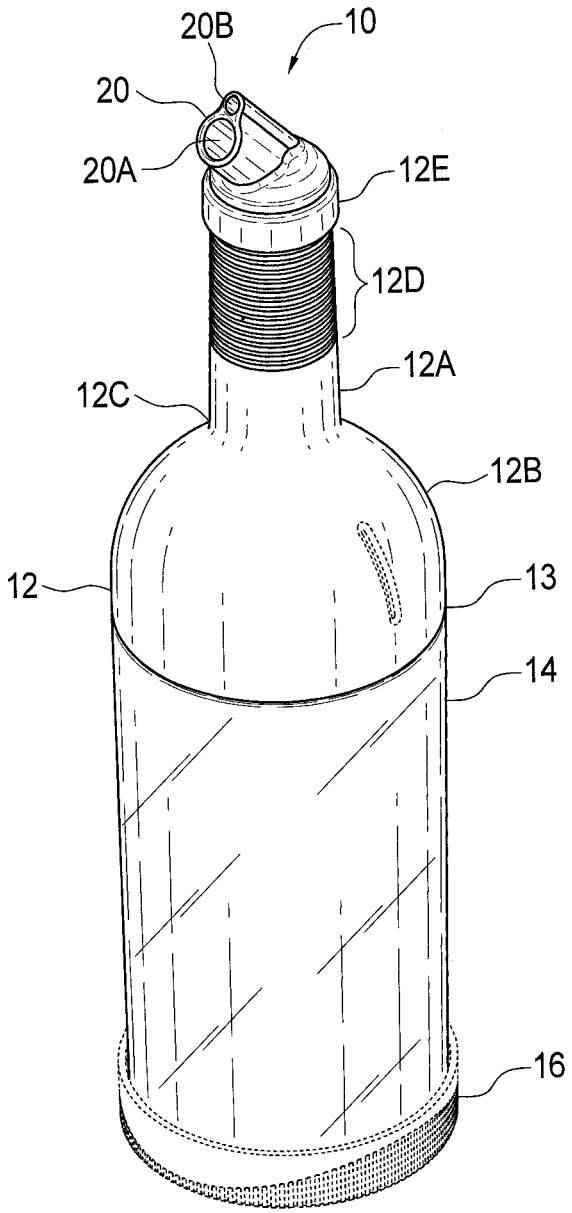
FIG. 1 shows a bar bottle according to an example embodiment of the invention.

FIG. 1 shows a bar bottle 10 according to an example embodiment of the invention. Bar bottle 10 includes an upper portion 12 removably attached to a lower portion 14 at a coupling 13. Coupling 13 may, for example, comprise screw threads 13A (see FIG. 2). Coupling 13 is designed to avoid leakage of the contents of bottle 10. For example, an angled surface 11 may be provided adjacent to the inner threads on top portion 12. This angled surface may create a water-tight seal when top portion 12 and lower portion 14 are screwed together. The angled surface may sealingly contact an outer edge of the top of lower portion 14. The angled surface may optionally also serve as a transition area between a thread area of top portion 12 which may have a wall that is thinner than a wall of an adjacent part of top portion 12. The mating of an angled surface with an edge allows for robust sealing. Other sealing designs may be used (e.g. providing a V-seal, O-ring or the like). Threads 13A are preferably multi-start threads (e.g. double-start threads). This allows top portion 12 and lower portion 14 to be screwed together quickly. As an example, dual-start threads may be provided such that the top portion 12 and lower portion 14 are fully coupled in approximately 1-2 turns (e.g. 1 ¼ turns).

Lower portion 14 may be entirely or in part transparent so that a user can see how full bottle 10 is, as well as ascertain the nature of the fluid being contained by bottle 10. In some embodiments lower portion 14 is made from a transparent grade of polypropylene (PP).

An optional cover 16 is detachably provided on the lower end of bottle 10. Cover 16 may provide a stable base for bottle 10 and may be removable to facilitate tightly stacking a plurality of bottles 10 for storage, either in a vertical or horizontal orientation.

Top portion 12 includes a neck 12A which joins an enlarged portion 12B at a base 12C of neck 12A.

Figure 5:
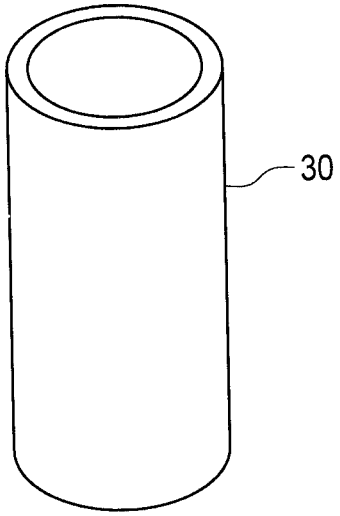
FIG. 5 is a perspective view of an example elastomeric sleeve.
Figure 4A:
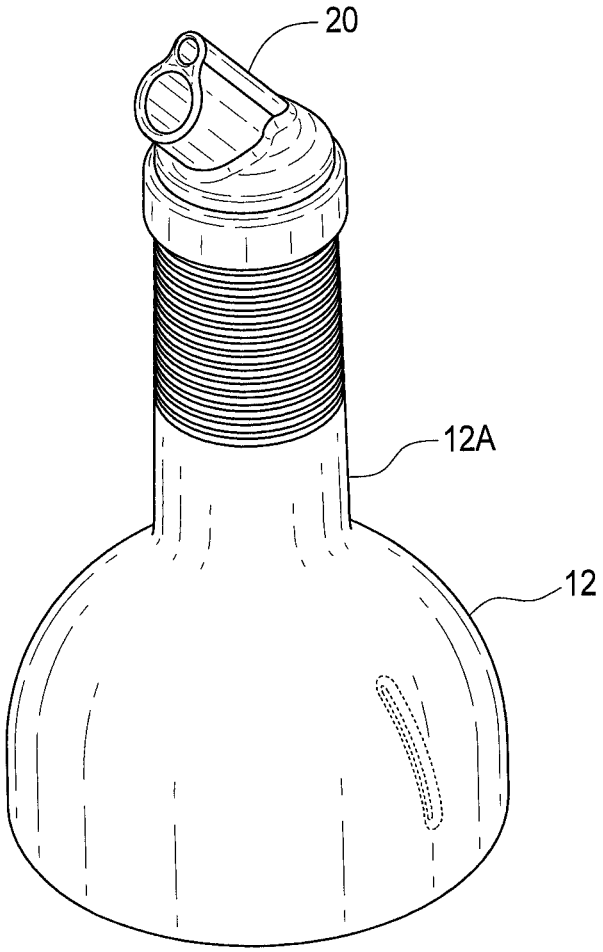
FIGS. 4A, 4B, and 4C are perspective top and bottom views of an integrally-formed top portion of the bottle of FIG. 1.
Figure 4B:
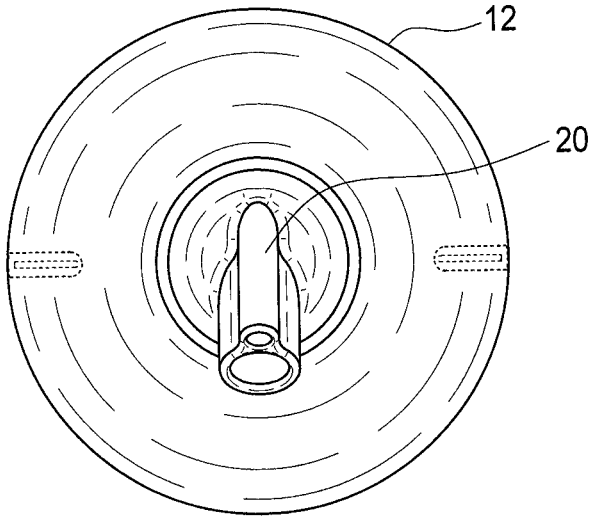
Figure 4C:
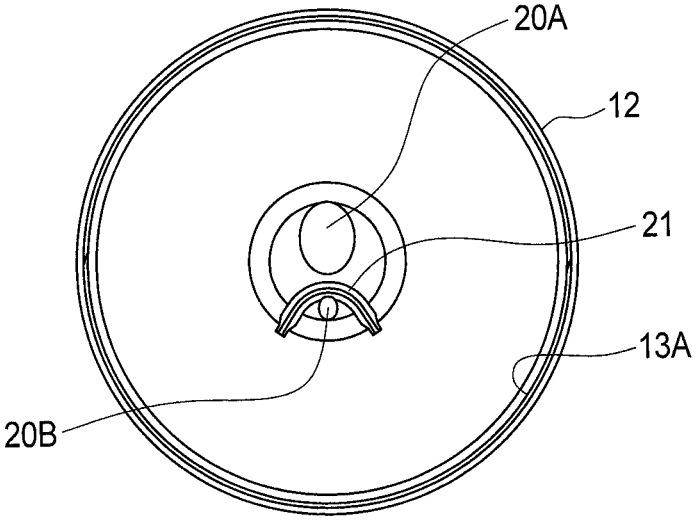

In the illustrated embodiment, neck 12A has a textured portion 12B to facilitate gripping neck 12A in order to pour contents from bottle 10. An expanded diameter portion 12E helps to prevent dropping bottle 10. An elastomeric sleeve 30 (see FIG. 5) may optionally be slipped over neck 12A. The elastomeric sleeve may engage on textured portion 12D and may abut against the lower side of enlarged diameter portion 12E.

In some embodiments, colour-coded silicone sleeves are provided such that different colours identify bottles 10 having different contents. A bottle 10 may be provided in combination with a set comprising a plurality of differently-coloured interchangeable elastomeric sleeves. The elastomeric sleeves may each be dimensioned to slip over enlarged diameter portion 12E and to snuggly hold against textured portion 12B.

Bottle 10 includes a pour spout 20 which is integrated with upper part 12 of bottle 10. Pour spout 20 includes a channel 20A through which liquids may flow out of bottle 10 and an air channel 20B which allows air to enter bottle 10 to make up for the loss of volume of fluid as fluid is being dispensed. Channel 20A and channel 20B may respectively be called first and second channels. Air channel 20B helps to reduce or eliminate "glugging" as liquid is dispensed from bottle 10.

Figure 2:
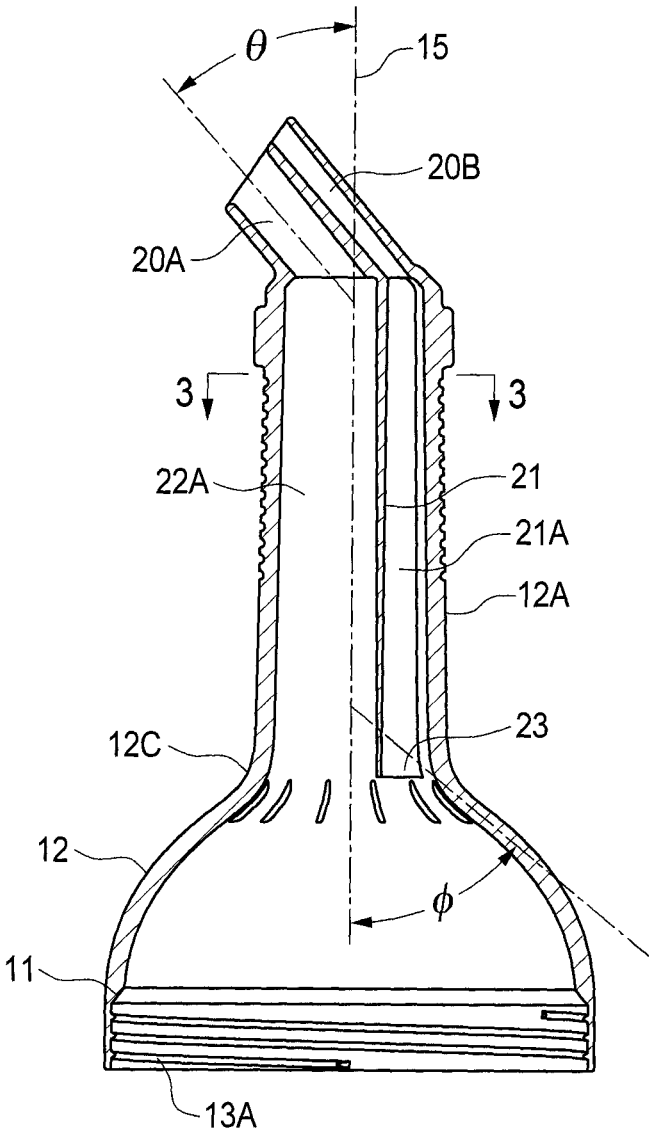
FIG. 2 is an elevation cross-section through a top portion of the bar bottle of FIG. 1.
Figure 3:
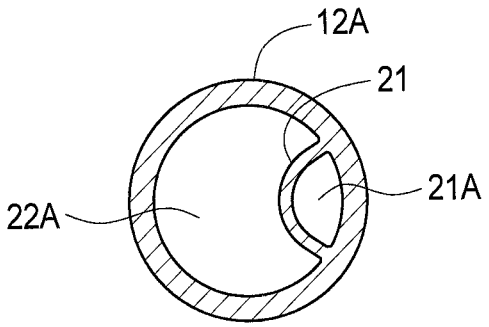
FIG. 3 is a transverse cross-section through a neck of the bar bottle shown in FIG. 1.

FIG. 2 shows in more detail the integration of pour spout 20 into bottle 10. As seen in FIG. 2, passages 20A and 20B extend at an angle θ to a longitudinal centre line 15 of neck 12A. In some embodiments, θ is in the range of 20° to 60°. For example, θ may be 45°±6°. A divider or partition 21 extends along neck 12A to an inner opening 23 that is at least at base 12C of neck 12A. Partition 21 provides a continuation or extension of air passage 20B that extends at least substantially all the way along neck 12A. The remainder of the interior of the bore of neck 12A provides a passage 22A through which liquids can flow from body 12B to passage 20A.

Air channel 20B may be smaller in diameter than main channel 20A. Air channel 20B is above main channel 20A when bottle 10 is standing upright, as shown in FIG. 1. In the illustrated embodiment, both of air channel 20B and main channel 20A are round in cross-section. One or both of channels 20A and 20B may optionally have other cross-sectional shapes.

In the illustrated embodiment, partition 21 and neck 12A and dispensing spout 20 are all integrally formed, for example by a plastic injection moulding process. Partition 21 may be tapered in thickness such that its inner end at opening 23 is thinner than its upper end where passage 20A turns to become passage 20B. Passage 21A may be generally tapered such that the cross-sectional area of passage 21A increases slightly as one travels from the point of intersection with passage 20B to opening 23.

In some embodiments, the entire upper portion 12 of bottle 10 is injection moulded as a single unitary piece.

Apart from providing cost-effective constructions, injection moulding upper part 12 of bottle 10 provides a number of advantages. These include the absence of cracks or crevices in which pathogens could collect, as well as providing a lightweight construction.

In some embodiments, all of bottle 10 is made of impact-resistant plastic materials. In some embodiments, bottle 10, as illustrated in FIG. 1, is made of only three separate pieces: top part 12, bottom part 14, and optional cap portion 16.

In some embodiments, a ratio of the length to the diameter of neck 12A is at least 2:1. In some embodiments, a ratio of the cross-section of expanded portion 12B to neck 12A is at least 4:1.

In some embodiments, opening 23 lies at an inflection point on the surface of bottle 10 where the surface of bottle 10 forms an angle φ with a centre line of passage 21A. φ may be approximately the same as θ such that, when bottle 10 is held to dispense a fluid with nozzle 20 oriented generally vertically, the wall of bottle 10 adjacent to opening 23 of passage 21A is also approximately vertically oriented.

Outer walls of the body and neck may follow surfaces of revolution about a common axis.

Interpretation Of Terms

Unless the context clearly requires otherwise, throughout the description and the claims:

- "comprise", "comprising", and the like are to be construed in an inclusive sense, as opposed to an exclusive or exhaustive sense; that is to say, in the sense of "including, but not limited to";
- "connected", "coupled", or any variant thereof, means any connection or coupling, either direct or indirect, between two or more elements; the coupling or connection between the elements can be physical, logical, or a combination thereof;
- "herein", "above", "below", and words of similar import, when used to describe this specification, shall refer to this specification as a whole, and not to any particular portions of this specification;
- "or", in reference to a list of two or more items, covers all of the following interpretations of the word: any of the items in the list, all of the items in the list, and any combination of the items in the list;
- the singular forms "a", "an", and "the" also include the meaning of any appropriate plural forts.

Words that indicate directions such as "vertical", "transverse", "horizontal", "upward", "downward", "forward", "backward", "inward", "outward", "vertical", "transverse", "left", "right", "front", "back", "top", "bottom", "below", "above", "under", and the like, used in this description and any accompanying claims (where present), depend on the specific orientation of the apparatus described and illustrated. The subject matter described herein may assume various alternative orientations. Accordingly, these directional terms are not strictly defined and should not be interpreted narrowly.

Where a component (e.g. a passage, spout, cover assembly, device, etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Specific examples of systems, methods and apparatus have been described herein for purposes of illustration. These are only examples. The technology provided herein can be applied to systems other than the example systems described above. Many alterations, modifications, additions, omissions, and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

It is therefore intended that the following appended claims and claims hereafter introduced are interpreted to include all such modifications, permutations, additions, omissions, and sub-combinations as may reasonably be inferred. The scope of the claims should not be limited by the preferred embodiments set forth in the examples, but should be given the broadest interpretation consistent with the description as a whole.

What is claimed is:

1. A dispensing bottle comprising:

a neck, a body joined to a base of the neck, the body larger in cross-section than the neck, a spout at an end of the neck remote from the body, the spout comprising at least a first passage and a second passage parallel to the first passage and smaller in cross-section than the first passage, each of the first and second passages in fluid communication with the body of the bottle by way of the neck, the first and second passages oriented at an angle to a longitudinal centerline of the neck;

a partition integrally formed with the neck and the spout, the partition connected to the spout between the first and second passages and extending continuously along the neck from the spout to an opening at the base of the neck, the partition forming a continuation of the second passage wherein the partition is tapered in thickness such that parts of the partition closer to the spout are thicker than parts of the partition closer to the body.

2. A dispensing bottle according to claim 1 wherein the extension of the second passage formed by the partition is tapered such that a cross-section area of the portion of the extension of the second passage closer to the body is larger than a cross section area of the extension of the second passage closer to the spout.

3. A dispensing bottle according to claim 2 wherein a wall of the body of the bottle adjacent to the opening formed by the partition at the base of the neck is oriented generally parallel to the first and second passages of the spout.

4. A dispensing bottle according to claim 2 wherein, in a cross-section of the neck and partition the partition is arcuate and joined along opposing edges to a wall of the neck.

5. A dispensing bottle according to claim 4 wherein an outer surface of the neck is textured at least in a portion near the end of the neck remote from the body.

6. A dispensing bottle according to claim 5 wherein the outer surface of the neck is textured by a pattern of grooves extending circumferentially around the neck.

7. A dispensing bottle according to claim 5 comprising an enlarged-diameter portion at the end of the neck remote from the body.

8. A dispensing bottle according to claim 7 comprising an elastomeric sleeve at least partially covering the textured portion of the neck.

9. A dispensing bottle according to claim 8 wherein the elastomeric sleeve comprises a colored silicone material.

10. A dispensing bottle according to claim 4 comprising an enlarged-diameter portion at the end of the neck remote from the body.

11. A dispensing bottle according to claim 10 in combination with a set comprising a plurality of colored elastic sleeves, the plurality of elastic sleeves comprising elastic sleeves of a plurality of colors, each of the sleeves dimensioned to resiliently slip over the enlarged diameter portion and to securely engage around the neck below the enlarged diameter portion.

12. A dispensing bottle according to claim 11 wherein the elastic sleeves comprise a colored silicone material.

13. A dispensing bottle according to claim 4 wherein the body of the bottle comprises first and second detachable parts, the first part formed integrally with the neck and spout, the first and second parts detachably coupled together at a threaded coupling in a cylindrical portion of the body.

14. A dispensing bottle according to claim 13 wherein the second portion of the body is transparent.

15. A dispensing bottle according to claim 14 comprising a cover having a diameter larger than the body and detachably affixed to an end of the second part of the body remote from the threaded coupling.

16. A dispensing bottle according to claim 13 wherein outer surfaces of the body and neck are circularly symmetrical about a common axis coincident with the longitudinal centerline of the neck.

17. A dispensing bottle according to claim 13 wherein the first part of the body, the neck and the spout are formed of injection-molded plastic.

18. A dispensing bottle according to claim 17 wherein the angle between the first and second passages and the longitudinal centerline of the neck is in the range of 20 to 60 degrees.

* * * * *